United States Patent [19]

Steinhart

[11] Patent Number: 4,547,112

[45] Date of Patent: Oct. 15, 1985

[54] SIGNATURE HANDLING APPARATUS

[75] Inventor: Horst K. Steinhart, Westminster, Calif.

[73] Assignee: Rima Enterprises, Huntington Beach, Calif.

[21] Appl. No.: 572,581

[22] Filed: Jan. 20, 1984

[51] Int. Cl.[4] ..... B65G 57/06

[52] U.S. Cl. ..... 414/31; 414/54; 414/66; 414/907

[58] Field of Search ..... 414/31, 54, 62, 65, 414/66, 907

[56] References Cited

U.S. PATENT DOCUMENTS

| | | | |
|---|---|---|---|
| 3,861,537 | 1/1975 | Duchinsky et al. | 271/212 X |
| 3,902,609 | 9/1975 | Ohlsson | 414/31 X |
| 4,024,965 | 5/1977 | Marth et al. | 198/374 X |
| 4,140,234 | 2/1979 | Steinhart | 74/66 X |
| 4,183,704 | 1/1980 | Steinhart | 414/31 |
| 4,264,255 | 4/1981 | Saro et al. | 414/31 |
| 4,271,755 | 6/1981 | Kintgen et al. | 414/82 X |
| 4,457,656 | 7/1984 | Kosina et al. | 414/31 |

*Primary Examiner*—Robert J. Spar
*Assistant Examiner*—Janice Krizek
*Attorney, Agent, or Firm*—Yount & Tarolli

[57] ABSTRACT

An improved apparatus is operable to stack signatures having one edge portion which is thicker than other edge portions of the signatures. The apparatus compensates for the thickness of the one edge portion by flattening the one edge portion and offsetting successive layers in a stack of signatures. The apparatus includes a platform which receives the signatures in an initial orientation. This platform is rotated about a vertical axis to offset a first group of signatures from their initial orientation. The signatures subsequently received on the platform have a relatively thick edge portion offset from the first group of signatures. After a retractable apparatus has been extended over the top of a group of signatures, the platform is raised to press the signatures against the retractable apparatus and thereby flatten the signatures.

21 Claims, 5 Drawing Figures

SIGNATURE HANDLING APPARATUS

BACKGROUND OF THE INVENTION

The present invention relates to a new and improved signature handling apparatus and more specifically to a signature handling apparatus for use in stacking signatures having one edge which is thicker than other edges of the signatures.

A known apparatus for stacking signatures having one edge thicker than other edges is disclosed in U.S. Pat. No. 4,183,704. The apparatus disclosed in this patent accumulates the signatures on a temporary holding platform formed by a plurality of tines connected with rotatable shafts. After a predetermined number of signatures, corresponding to a portion of a stack of signatures, has been collected on the temporary holding apparatus, the signatures are dropped onto a turntable.

The turntable is rotated through 180° after receipt of each portion of the stack of signatures from the temporary holding platform. This results in the relatively thick edges of the signatures in one portion of the stack being offset from the relatively thick edges of signatures in another portion of the stack. Since the relatively thick edges of the signatures are offset, the accumulation of the relatively thick edges along one side of the stack and a resulting upward extension of that side of the stack is avoided.

SUMMARY OF THE PRESENT INVENTION

The present invention relates to a new and improved signature handling apparatus for use in stacking signatures having one edge which is thicker than other edges of the signatures. The relatively thick edges of the signatures are compensated for by (1) compressing the relatively thick edges to flatten the signatures and (2) offsetting the relatively thick edges in successive layers in a stack of signatures.

The signature handling apparatus includes a platform which receives the signatures in an initial spatial orientation. The platform is rotated about a vertical axis to offset a first group of signatures on the platform from the initial spatial orientation. This results in the signatures which are subsequently received on the platform in the initial spatial orientation having relatively thick edges which are offset from the relatively thick edges of the signatures which had previously been deposited on the platform.

Each group of signatures on the platform is compressed before the succeeding group of signatures is deposited on the platform. Thus, once a group of signatures has been deposited on the platform, a retractable apparatus is extended over the platform. The platform is then raised to press the signatures on the platform against the retractable apparatus which is extending over the platform. This results in a flattening of the relatively thick edges of the signatures which are on the platform.

Accordingly, it is an object of this invention to provide a new and improved apparatus for use in stacking signatures having one edge which is thicker than other edges and wherein the relatively thick edges of the signatures are flattened and wherein the relatively thick edges of signatures in successive groups of signatures are offset from each other.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

General Description

Figure 1:
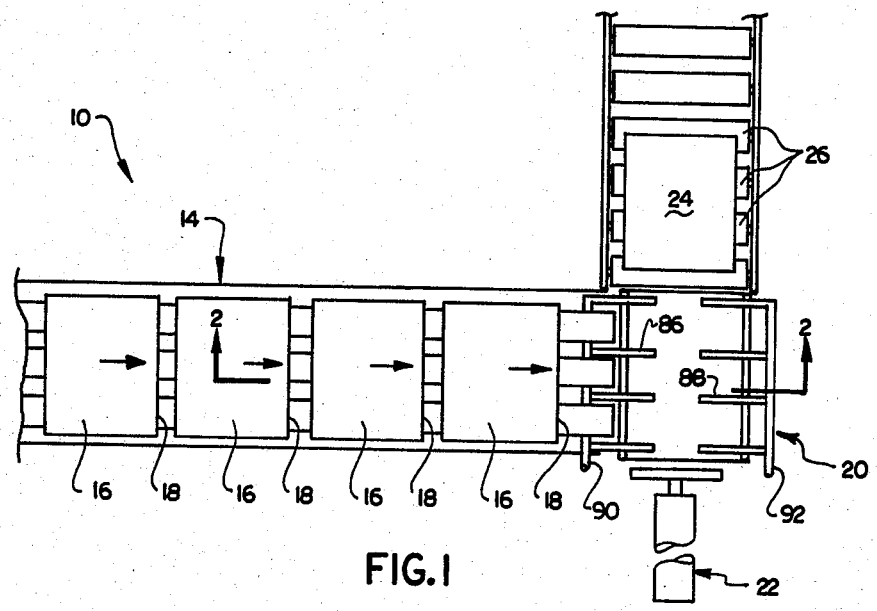
FIG. 1 is a schematic plan view of a signature handling apparatus constructed in accordance with the present invention.
Figure 2:
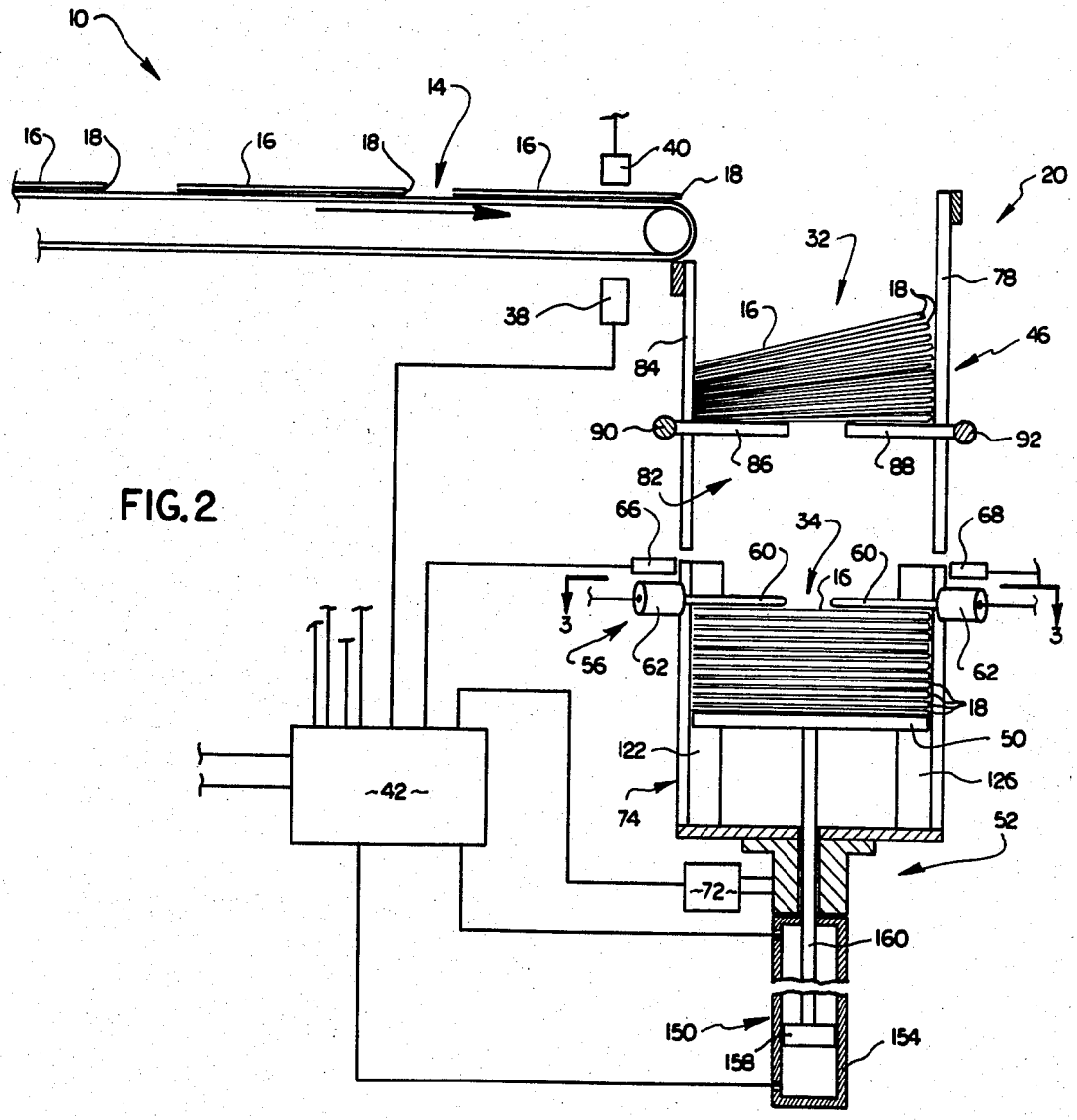
FIG. 2 is a schematic sectional view, taken generally along the line 2—2 of FIG. 1, illustrating the manner in which a group of signatures is compressed by raising a platform to flatten the signatures against extendable members while a next succeeding group of signatures is being accumulated on a temporary holding platform.

A signature handling apparatus 10 constructed in accordance with the present invention is illustrated schematically in FIGS. 1 and 2. The signature handling apparatus 10 is operable to produce generally rectangular and relatively stable stacks of signatures which can be readily handled even though the signatures have one edge portion which is thicker than the other edge portions. Signatures which are folded along one edge portion tend to expand at that edge portion and be thicker along the folded edge portion than at other edge portions of the signatures. If these signatures are stacked without compensating for the relatively thick folded edge portion of the signatures, one side of the stack tends to project a substantial distance upwardly relative to the other sides of the stack with a resulting instability which increases the difficulty of handling the stack of signatures.

The signature handling apparatus 10 compensates for the relatively thick folded edge portion of the signatures by flattening the folded edge portions of the signatures. In addition, the apparatus 10 compensates for the relatively thick edge portion of the signatures by offsetting successive layers in a pile of signatures. Although the relatively thick edge portion of the signatures is described herein as resulting from folding the signatures, it should be understood that the relatively thick edge portion of the signatures could be due to other causes, such as stapling, binding, or the provision of narrow inserts in the signatures.

The signature handling apparatus 10 includes an infeed conveyor 14 along which signatures 16 are fed in a spaced apart relationship with their relatively thick folded edge portions 18 leading. The signatures are fed from the infeed conveyor 14 to a signature stacking apparatus 20. A pusher assembly 22 (FIG. 1) is operable to sequentially push stacks of signatures 24 onto a delivery conveyor 26.

Each stack 24 (see FIG. 4) of signatures includes a plurality of layers or pile sections, such as an upper layer or pile section 32 and a lower layer or pile section 34. Each of the signatures 16 is fed to the signature stacking apparatus 20 with a relatively thick folded edge portion 18 of the signature leading, in the manner illustrated schematically in FIG. 2. However in order to promote the formation of a relatively stable stack 24 of signatures, the flattened folded edge portions 18 of the signatures in one layer or pile portion of the stack 24 is offset from the folded edge portion 18 of the signatures in an adjacent layer.

Figure 4:
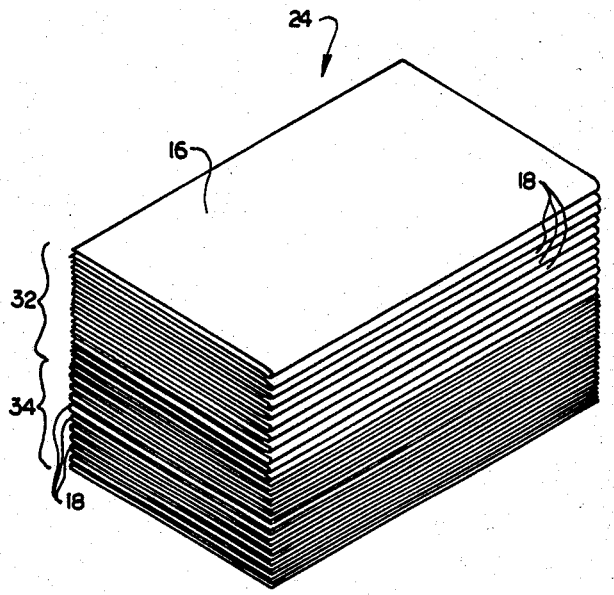
FIG. 4 is a schematic illustration depicting the manner in which relatively thick folded edge portions of an upper group of signatures in a stack of signatures is offset from relatively thick folded edge portions of a lower group of signatures in the stack of signatures.

The folded edge portions 18 of the upper layer 32 in the stack 24 of signatures face toward the right, as viewed in FIG. 4. The folded edge portions 18 of the lower layer 34 in the stack 24 of signatures face toward the left. This results in a generally rectangular stack 24 of signatures which is relatively stable and can be easily handled. Although the folded edge portions 18 in the upper and lower layers 32 and 34 of signatures in the stack 24 of signatures have been shown (FIG. 4) as being offset from each other by 180°, it is contemplated that the folded edge portions could be offset by 90°. Of course, if this was done, the stack 24 of signatures would contain at least four layers in order to obtain the desired rectangular configuration.

Signatures are fed to the signature stacking apparatus 20 by the infeed conveyor 14. As the signatures 16 are sequentially fed toward the stacking apparatus 20, a light source 38 cooperates with a light responsive sensor 40 to provide signals which enable a control apparatus 42 to count the number of signatures fed to the stacking apparatus 20 in a known manner.

As the signatures are fed to the stacking apparatus 20, they are accumulated in a temporary holding assembly 46 (FIG. 2) until a predetermined number of signatures have been accumulated. When the predetermined number of signatures have been accumulated in the signature holding assembly 46, a layer or pile portion is dropped from the holding apparatus 46 onto a platform or table 50 in a stack compression and compensating apparatus 52.

While a next succeeding layer or pile portion of signatures is being accumulated in the temporary signature holding apparatus 46, the platform 50 is lowered. The platform is lowered until the top of a group of signatures on the platform 50 is below the level of a retractable apparatus 56. As the platform 50 is being lowered, compression rods 60 are retracted in piston and cylinder assemblies 62. Shortly after the upper edge of the lower layer of signatures has moved downwardly past the level of compression rods 60, the motors 62 are operated to move the rods to their extended positions shown in FIG. 2.

Thus, as the layer 34 of signatures on the platform 50 is lowered, the layer of signatures moves past a light source 66 and light sensitive element 68. When this happens, a signal is transmitted to the control apparatus 42. After a short time delay, during which the upper edge of the layer 34 of signatures moves downwardly below the compression rods 60, the motors 62 are operated to extend the compression rods.

The platform 50 is then raised to press the pile portion or layer 34 against the extended compression rods 60. This compresses the layer 34 and flattens the relatively thick folded edge portions 18 of the signatures 16. Flattening the edge portions of the signatures decreases the amount by which the edge portion of the layer 34 containing the thick edges of the signatures extends upwardly above the opposite edge portion of the layer.

In order to further compensate for the relatively thick folded edge portions 18 of the signatures 16, the layer 34 and platform 50 are rotated so that the folded edge portions of the signatures on the platform are offset from the folded edge portions of a next succeeding layer of signatures being accumulated in the signature holding assembly 46. Thus, while a layer 34 is being pressed against the extended compression rods 60, a drive assembly 72 is operated to rotate the platform 50. A stack positioning assembly 74 rotates with the platform 50 about a vertical central axis of the stack compression and compensation apparatus 52.

Operation of the drive assembly 72 rotates the layer 34 through 180° from the initial position shown in FIG. 2. This results in the relatively thick folded edge portions 18 of the signatures 16 in the layer 34 being disposed immediately beneath the relatively thin open edge portions of the signatures being accumulated in the temporary signature holding assembly 46. Although it is preferred to rotate the layer 34 through 180° from the initial position shown in FIG. 2 by operation of the drive assembly 72, it is contemplated that the drive assembly 72 could be operated to rotate the layer 34 through 90° for each layer that is accumulated in the stack compression and compensation apparatus 52.

When the next succeeding layer or pile portion 32 has been accumulated in the temporary signature holding assembly 46, the next succeeding layer 32 is dropped onto the preceding layer 34 on the platform 50. As the layer 32 drops downwardly, it moves between the light source 66 and photocell 68. This signals the control apparatus 42 to operate the motors 62 and retract the compression rods 60. After a slight time delay, the platform 50 is lowered.

As the platform 50 moves downwardly, the upper edge portion of the layer 32 will move downwardly past the light source 66 and photocell 68. This signals the control apparatus 42 to interrupt the downward movement of the platform 50 after sufficient time has passed to enable the upper edge of the layer 32 to move below compression rods 60. The motors 62 are then operated to extend compression rods 60. The platform 50 is then raised to press the upper layer 32 against the compression rods 60 and flatten the relatively thick folded edges of the signatures in the layer 32.

Assuming that the stack 24 (see FIG. 4) is to contain only the upper layer 32 and the lower layer 34, once the upper layer 32 has been compressed against the rods 60, the platform 50 is lowered. The pusher assembly 22 (see FIG. 1) is then operated to push the stack out of the signature stacking apparatus 20 onto the delivery conveyor 26.

Of course, if more than two layers of signatures were to be provided in the stack 24, the foregoing process would be repeated until the desired number of layers had been accumulated in the stack. Regardless of the number of layers, the stack 24 will be generally rectangular in configuration and will be comparatively stable. This is because the relatively thick folded edge portions 18 will have been compensated for by flattening the signatures against the compression rods 60 and by offsetting the layers in the stack.

TEMPORARY SIGNATURE HOLDING ASSEMBLY

The temporary signature holding assembly 46 receives each of the signatures 16 in turn from the infeed conveyor 14. As the signatures are fed by the conveyor 14 into the temporary signature holding assembly 46, the leading folded edge portion 18 of each of the signatures impacts against a vertical alignment bar 78 (see FIG. 2). The signatures then fall downwardly onto a temporary platform 82 disposed between alignment bars 78 and 84.

The temporary platform 82 is formed by a plurality of parallel fingers or tines 86 and 88 which extend inwardly from rotatable shafts 90 and 92. When a layer of signatures containing a predetermined number of signatures, which is counted by the light source 38 and photocell 40, has accumulated on the temporary platform 82, the shafts 90 and 92 are rapidly rotated through 360° to allow the layer of signatures to drop downward toward the platform 50. Thus, the shaft 90 is rotated in a clockwise direction (as viewed in FIG. 2) and the shaft 92 is rotated in a counterclockwise direction. The speed of rotation of the shafts 90 and 92 is such that the fingers or tines 86 and 88 are back in the position shown in FIG. 2 before the signature which is to form the bottom of the next succeeding layer has dropped downwardly in the temporary signature holding assembly 46.

The temporary signature holding assembly 46 has the same construction as is described in U.S. Pat. No. 4,183,704. Therefore, the construction of the temporary signature holding assembly 46 will not be further described herein in order to avoid prolixity of description. However, it should be understood that temporary signature holding assemblies of a different construction could be used if desired.

STACK COMPRESSION AND COMPENSATION APPARATUS

The stack compression and compensation apparatus 52 (see FIG. 5) includes the stack positioning assembly 74. The stack positioning assembly 74 positions the layers 32 and 34 (FIGS. 2 and 4) relative to the platform 50 as they drop from the temporary holding assembly 46.

The stack positioning assembly 74 includes a plurality of upright positioning bars 102, 104, 106, 108, 110 and 112 which engage the edge portions of the signatures to position them transversely to the platform 50. A plurality of gates are connected with the positioning bars to locate the signatures along the platform. Thus, a gate 114 is pivotally connected with the positioning bar 102 by spring loaded hinge connections 118. Gates 122, 124 and 126 are pivotally connected with the positioning bars 106, 108 and 112 in a similar manner.

The gates 114, 122, 124 and 126 are spring pressed against the sides of the signatures disposed on the platform 50 to maintain the signatures in position along the platform. The platform 50 and stack positioning assembly 74 are rotated together through 180° by the drive assembly 72 to offset layers of signatures relative to each other. Therefore, the pusher assembly 22 (see FIG. 1) may push a signature out through the gates 122 and 126 (see FIG. 5) or out through the gates 114 and 124, depending upon the orientation of the platform 50 and stack positioning assembly 74 relative to the pusher assembly 22. Since the gates 114, 122, 124 and 126 are all hinged for outward pivotal movement, the stack can be pushed from either end of the platform 50. Of course the pusher assembly 22 is small enough to extend through the space between the gates.

Figure 5:
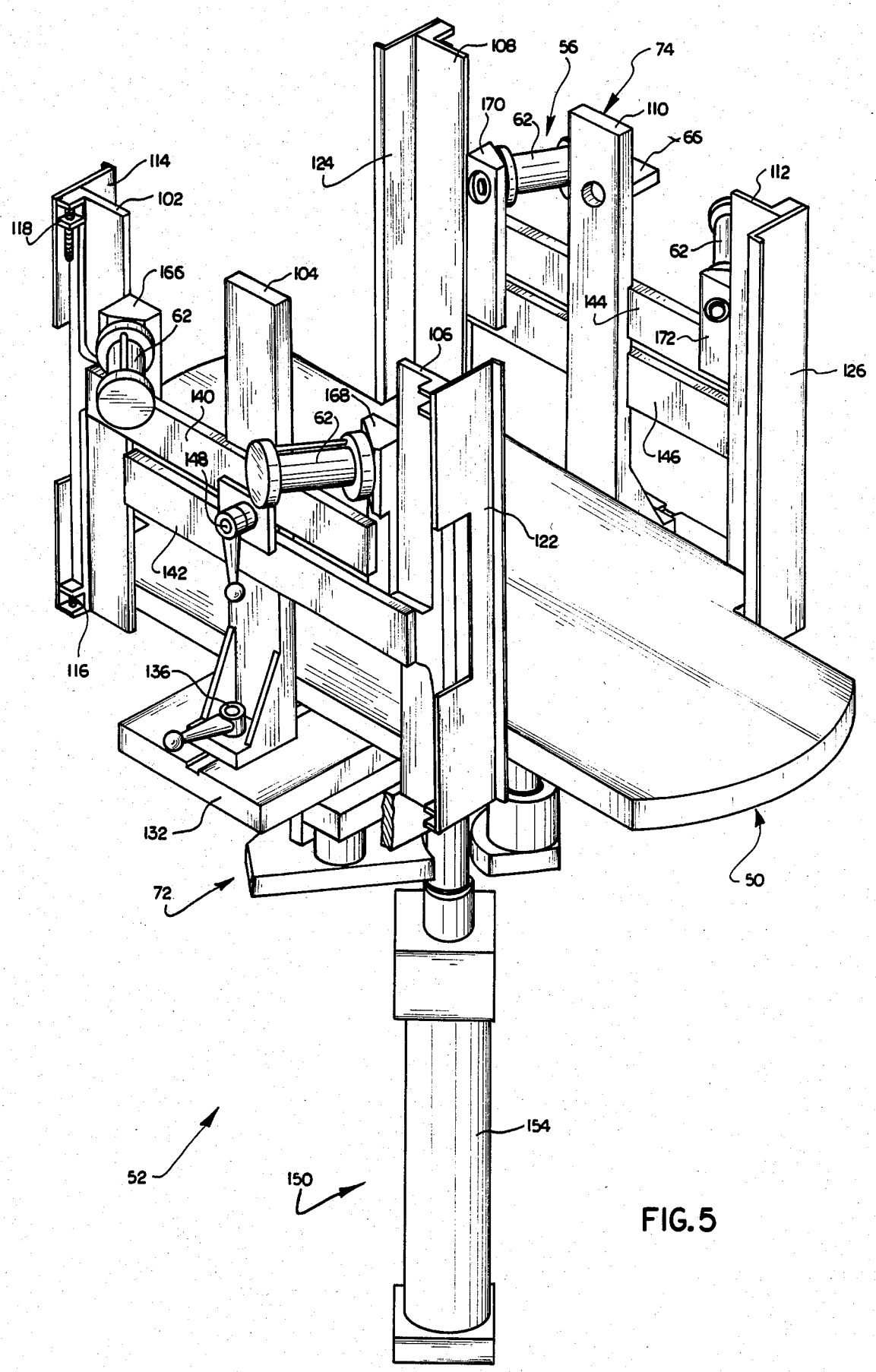
FIG. 5 is a fragmentary pictorial illustration of a portion of the apparatus illustrated in FIG. 2.

The signature positioning assembly 74 includes a base plate 132 on which the positioning bars 102–112 are supported. Thus, the center positioning bars 104 and 110 are connected with the base plate 132 by a pair of releasable clamp assemblies, only the clamp assembly 136 being illustrated in the drawings. The vertical end positioning bars 102, 106, 108 and 112 are connected with the center positioning bars 104 and 110 by horizontal cross members 140, 142, 144 and 146. Therefore, upon release of the clamp assemblies 136 for the center positioning bars 104 and 110, the locations of all of the positioning bars can be adjusted relative to the base plate 132 to accommodate stacks of different widths. Similarly, a pair of clamp assemblies 148, only one of which is shown in FIG. 5, are releasable to enable the positions of the bars 102, 106, 108 and 112 and gates 114, 122, 124 and 126 to be adjusted to accommodate stacks of different lengths.

The platform drive assembly 72 rotates the platform 50 and stack positioning assembly 74 about their coincident vertical central axes while signatures on the platform are pressed against the compression rods 60. The drive assembly 72 is operable to rotate the platform 50 and stack positioning assembly 74 back and forth along a 180° arc of movement. Any known drive system could be utilized to rotate the platform 50 and stack positioning assembly 74. However, it is preferred to use the drive assembly disclosed in U.S. Pat. No. 4,140,234. Operation of the pneumatic piston and cylinder type motor in the drive assembly 72 is regulated by the control apparatus 42 in a known manner.

The platform 50 is raised and lowered by the pneumatic motor 150. The motor 150 includes a cylinder 154 which is fixedly connected with the base plate 132 of the stack positioning assembly 74. The motor 150 includes a piston 158 (see FIG. 2) which is connected with the platform 50 by a cylindrical piston rod 160.

To raise the platform 50, the control apparatus 42 directs air under pressure into the head end of the cylinder 154 and exhausts the rod end of the cylinder. Similarly, when the platform 50 is to be lowered, the head end of the cylinder 154 is exhausted to the atmosphere and air pressure is supplied to the rod end of the cylinder. The force with which the signatures are pressed against the compression rods 60 is controlled by regulating the air pressure applied against the head end of the piston 158.

The platform 50 and cylindrical piston rod 160 are held against rotation relative to the cylinder 154 and base 132 (see FIG. 5) by engagement of the edges of the platform 50 with the upright positioning bars 102–112. To facilitate vertical movement of the platform during operation of the motor 150, anti-friction surfaces formed by threaded fasteners of a polymeric material, on the sides of the platform 50 rub against the inner side surfaces of the positioning bars 102–112.

It is contemplated that it may be desirable to hold the platform 50 against rotation by holding the piston rod 160 against rotation. This can be done by forming a section of the piston rod with a polygonal cross sectional configuration and sliding the piston rod in a similarly shaped sleeve. Of course, a slot and key-way arrangement could be used if desired. By holding the piston rod 160 and platform 50 against rotation in this manner, the positioning bars 102–112 can be moved away from the side edges of the platform to enable the platform to accommodate stacks having a slightly greater area than the top of the platform.

Figure 3:
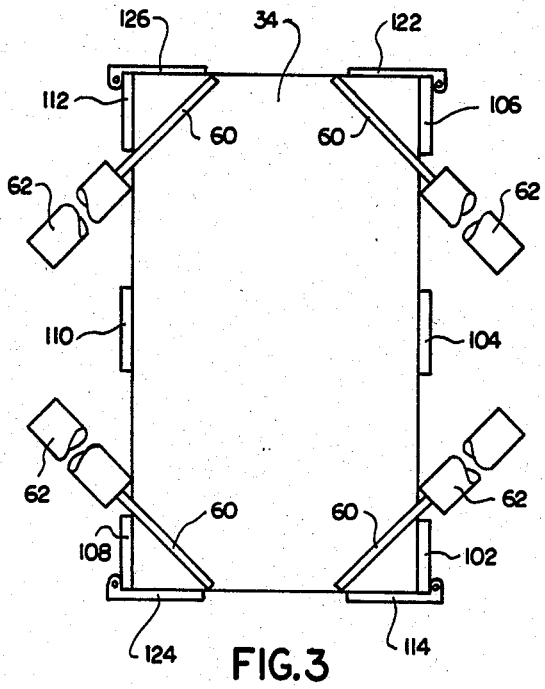
FIG. 3 is a schematic plan view, taken generally along the line 3—3 of FIG. 2, illustrating the manner in which retractable members extend over a group of signatures being pressed upwardly by the platform.

The retractable apparatus 56 includes pneumatic piston and cylinder type motors 62 which are mounted on the cross members 140–146 on mounting blocks 166, 168, 170 and 172 (see FIG. 5). The mounting blocks 166–172 support the motors 56 with their longitudinal central axes skewed at acute angles relative to the edges of the platform 50. This results in the compression rods 60 extending across corner portions of the layer of signatures 34 disposed on the platform 50 in the manner shown in FIG. 3. Thus, the central axes of the compression rod 60 are skewed at acute angles relative to the edge portions of the signatures. Although it is preferred to use only four compression rods, it is contemplated that additional compression rods and motors could be used if desired.

Since the layers 32 and 34 are rotated through 180° by the drive assembly 72, the compression rods 60 which extended over the thick folded edge portion of the layer 34 will extend over the relatively thin open edge portion of the layer 32. Similarly, the compression rods 60 which extended over the thin open edge portion of the layer 34 will extend over the thick folded edge portion of the layer 32. The motor 150 is effective to continuously press the signatures on the platform 50 upwardly against the compression rods 60 from a time shortly after the signatures have been lowered beneath the light source 66 and photocell 68 until a next succeeding layer of signatures drops downwardly through the space between the light source and photocell.

In view of the foregoing it is apparent that the present invention relates to a new and improved signature handling apparatus 10 for use in stacking signatures 16 having one edge portion 18 which is thicker than other edge portions of the signature. The relatively thick edge portions 18 of the signatures are compensated for by (1) compressing the relatively thick edge portions to flatten the signatures and (2) offsetting the relatively thick edges portions of the signatures in successive layers 32 and 34 in a stack 24 of signatures.

The signature handling apparatus 10 includes a platform 50 which receives the signatures 16 with the relatively thick edge portion 18 of each signature in an initial spatial orientation (FIG. 2). The platform 50 is rotated about a vertical axis to offset a first group of signatures 34 on the platform from the initial spatial orientation. This results in the signatures 16 in the group of signatures 32 being subsequently received on the platform 50 in the initial spatial orientation having relatively thick edge portions 18 offset from the relatively thick edge portions of the groups 34 of signatures which had previously been deposited on the platform 50.

Each group of signatures on the platform 50 is compressed before the succeeding group of signatures is deposited on the platform. Thus, once the signatures of the group 34 of signatures has been deposited on the platform 50, a retractable apparatus 56 is extended over the platform. The platform 50 is then raised to press the signatures on the platform against the retractable apparatus 56 which is extending over the platform. This results in a flattening of the relatively thick edge portions 18 of the signatures which are disposed on the platform 50. While the signatures are being pressed against the retractable apparatus 56, the platform 50 and signatures are rotated by the drive assembly 72.

Having described one specific preferred embodiment of the invention, the following is claimed:

1. An apparatus for use in stacking signatures having linear edge portions with one edge portion thicker than other edge portions and compensating for the thickness of the one edge portion by flattening the one edge portion and offsetting successive layers of a stack of the signatures, said apparatus comprising platform means for receiving signatures with the one edge portion in an initial spatial orientation, first drive means for rotating said platform means through a predetermined arcuate distance about a vertical axis to offset a first group of signatures from the initial spatial orientation so that signatures subsequently received on said platform means in the initial spatial orientation have their one edge portion offset from the one edge portion of signatures in the first group of signatures, retractable means operable between a retracted condition and an extended condition in which said retractable means extends over the top of signatures on said platform means, said retractable means including a first compression member which is skewed at an acute angle to and extends across the one edge portion of a signature adjacent to a first corner of the signature when said retractable means is in the extended condition, and a second compression member which is skewed at an acute angle to and extends across the one edge portion of the signature adjacent to a second corner of the signature when said retractable means is in the extended condition, and second drive means for raising said platform means to press signatures on said platform means against said retractable means when said retractable means is in the extended condition to compress the first group of signatures and thereby flatten the one edge portion of the signatures in the first group of signatures.

2. An apparatus as set forth in claim 1 further including detector means for detecting the presence of signatures at a location above said retractable means and control means for effecting operation of said retractable means from the extended condition to the retracted condition in response to said detector means detecting the presence of a signature.

3. An apparatus as set forth in claim 2 wherein said control means includes means for effecting operation of said second drive means to lower said platform means to a level at which the uppermost signature on said platform means is at a level below said retractable means while said retractable means is in the retracted condition and for effecting operation of said retractable means from the retracted condition to the extended condition while the uppermost signature on said platform means is below said retractable means.

4. An apparatus as set forth in claim 3 wherein said control means further includes means for effecting operation of said first drive means to rotate said platform means while said retractable means is in the extended condition and the signatures on said platform means are being pressed against said retractable means.

5. An apparatus as set forth in claim 1 further including positioning means for engaging the edge portions of signatures disposed on said platform means to position the signatures relative to said platform means, said first drive means being operable to rotate said positioning means with said platform means, said second drive means being operable to raise and lower said platform means relative to said positioning means.

6. An apparatus as set forth in claim 5 wherein said retractable means is connected with said positioning means for rotation therewith upon operation of said first drive means, said retractable means including first means for engaging the one edge portion of the first group of signatures and another edge portion of the signatures subsequently received on said platform means and second means for engaging the one edge portion of the signatures subsequently received on said platform means and another edge portion of the first group of signatures.

7. An apparatus as set forth in claim 1 wherein said retractable means includes first motor means connected with said first member for moving said first member between a first position extending over a first portion of said platform means and a second position, and second motor means connected with said second member for moving said second member between a first position extending over a second portion of said platform means and a second position.

8. An apparatus for use in stacking signatures having four linear edge portions which intersect at four corners of the signatures with one edge portion thicker than other edge portions and compensating for the thickness of the one edge portion by compressing the one edge portion and offsetting successive groups of signatures in a stack of the signatures, said apparatus comprising platform means for receiving signatures in an initial spatial orientation, first drive means for rotating said platform means through a predetermined arcuate distance about a vertical axis to offset a first group of signatures from the initial spatial orientation so that a second group of signatures subsequently received on said platform means have their one edge portion offset from the one edge portion of signatures in the first group of signatures, a plurality of compression members, motor means for moving said compression members from retracted positions to extended positions extending over said platform means and for moving said compression members from their extended positions to their retracted positions, said motor means and plurality of compression members being connected with said platform means for rotation therewith under the influence of said first drive means, said plurality of compression members including first and second compression members which extend across edge portions of the first group of signatures at locations adjacent to the one edge portion when said first and second compression members are in their extended positions over the first group of signatures and third and fourth compression members which extend across edge portions of the first group of signatures at locations adjacent to an edge portion opposite from the one edge portion when said third and fourth compression members are in their extended positions over said first group of signatures, said first and second compression members extending across said second group of signatures at locations adjacent to the edge portion opposite from the one edge portion of the signatures of the second group of signatures when the second group of signatures is disposed on top of the first group of signatures and said first and second compression members are in their extended positions, said third and fourth compression members extending across said second group of signatures at locations adjacent to the one edge portion of the signatures of the second group of signatures when the second group of signatures is disposed on top of the first group of signatures and said third and fourth compression members are in their extended positions, and second drive means for raising said platform means to press signatures on said platform means against said first, second, third and fourth compression members when said compression members are in their extended positions to compress the signatures on said platform means adjacent to the one edge portion and the edge portion opposite from the one edge portion of the signatures.

9. An apparatus as set forth in claim 8 further including detector means for detecting the presence of signatures at a location above said compression members and control means for effecting operation of said motor means to move said compression members from their extended positions to their retracted positions in response to said detector means detecting the presence of a signature.

10. An apparatus as set forth in claim 9 wherein said control means includes means for effecting operation of said second drive means to lower said platform means to a level in which the uppermost signature on said platform means is at a level below said compression members while said compression members are in their retracted positions and for effecting operation of said motor means to move said compression members from their retracted positions to their extended positions while the uppermost signature on said platform means is below said retractable means.

11. An apparatus as set forth in claim 10 wherein said control means further includes means for effecting operation of said first drive means to rotate said platform means while said compression members are in their extended positions and the signatures on said platform means are being pressed against said compression members.

12. An apparatus as set forth in claim 8 further including positioning means for engaging the edge portions of signatures disposed on said platform means to position the signatures relative to said platform means, said first drive means being operable to rotate said positioning means with said platform means, said second drive means being operable to raise and lower said platform means relative to said positioning means.

13. An apparatus as set forth in claim 12 wherein said motor means is connected with said positioning means for rotation therewith upon operation of said first drive means.

14. An apparatus as set forth in claim 8 wherein said first compression member is skewed at an acute angle to and extends across the one edge portion of a signature adjacent to a first corner of the signature when said retractable means is in the extended condition, and said second compression member is skewed at an acute angle to and extends across the one edge portion of the signature adjacent to a second corner of the signature when said first and second compression members are in their extended positions.

15. An apparatus as set forth in claim 8 further including signature holding means disposed above said platform means for receiving signatures sequentially and temporarily holding the signatures to form a pile portion and for dropping the pile portion onto said platform means with the one edge portion of each of the signatures in the pile portion in the initial spatial orientation.

16. An apparatus as set forth in claim 8 further including a plurality of positioning members having upwardly extending side surfaces which engage the signatures on said platform means to position the signatures relative to said platform means, said motor means including a plurality of motors each of which is connected with one of said compression members and is disposed adjacent to and connected with an upper end portion of one of said positioning members, said positioning members being connected with said platform means for rotation therewith upon operation of said first drive means, said platform means being movable relative to said positioning members upon operation of said second drive means.

17. An apparatus as set forth in claim 16 further including a plurality of gate members, each of said gate members being pivotally connected with one of said positioning members and being pivotal relative to said one positioning member between a closed position engaging signatures on said platform means and an open position, biasing means connected with said gate members for urging said gate members toward their closed positions, and pusher means for pushing signatures on said platform means against at least one of said gate members to move said one gate member from its closed position to its open position against the influence of said biasing means and for pushing the signatures off of said platform means through an opening partially defined by said one gate member.

18. An apparatus as set forth in claim 16 further including detector means for detecting the presence of signatures at a location above said compression members and control means for effecting operation of said motors to move said compression members from their extended positions to their retracted positions in response to said detector means detecting the presence of a signature.

19. An apparatus as set forth in claim 18 wherein said control means includes means for effecting operation of said second drive means to lower said platform means to a level in which the uppermost signature on said platform means is at a level below said compression members while said compression members are in their retracted positions and for effecting operation of said motor means to move said compression members from their retracted positions to their extended positions while the uppermost signature on said platform means is below said compression members.

20. An apparatus as set forth in claim 16 further including signature holding means disposed above said platform means for receiving signatures sequentially and temporarily holding the signatures to form a pile portion and for dropping the pile portion onto said platform means with the one edge portion of each of the signatures in the pile portion in the initial spatial orientation.

21. An apparatus as set forth in claim 8 wherein said motor means includes a plurality of motors each of which is connected with one of said compression members, each of said motors being operable in a first direction to move one of said compression members from its retracted position to its extended position and being operable in a second direction to move said one compression member from its extended position to its retracted position.

* * * * *